US008485166B2

(12) United States Patent
Aida et al.

(10) Patent No.: US 8,485,166 B2
(45) Date of Patent: Jul. 16, 2013

(54) IGNITION DEVICE FOR INTERNAL COMBUSTION ENGINE

(75) Inventors: Futoshi Aida, Chiyoda-ku (JP); Hiroshi Okuda, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 359 days.

(21) Appl. No.: 13/014,401

(22) Filed: Jan. 26, 2011

(65) Prior Publication Data

US 2012/0060804 A1 Mar. 15, 2012

(30) Foreign Application Priority Data

Sep. 15, 2010 (JP) ..... 2010-206664

(51) Int. Cl.
*F02P 3/09* (2006.01)

(52) U.S. Cl.
USPC ..... 123/597; 123/620; 123/652

(58) Field of Classification Search
USPC ..... 123/594–597, 604, 605, 618, 620, 123/623, 628, 640, 644, 652, 406.66, 143 R, 123/143 A, 143 B, 143 C, 169 R
See application file for complete search history.

(56) References Cited

U.S. PATENT DOCUMENTS

| | | | | |
|---|---|---|---|---|
| 6,131,542 | A | 10/2000 | Suckewer et al. | |
| 6,196,208 | B1 * | 3/2001 | Masters | 123/597 |
| 6,305,365 | B1 * | 10/2001 | Maeoka et al. | 123/604 |
| 6,484,707 | B1 * | 11/2002 | Frus et al. | 123/620 |
| 6,662,793 | B1 * | 12/2003 | Allen et al. | 123/620 |
| 6,976,482 | B2 * | 12/2005 | Bittner | 123/595 |
| 8,356,588 | B2 * | 1/2013 | Johnston et al. | 123/597 |
| 2002/0017284 | A1 * | 2/2002 | Masters | 123/597 |
| 2004/0084035 | A1 * | 5/2004 | Newton | 123/630 |
| 2008/0141986 | A1 * | 6/2008 | Mizutani | 123/604 |

FOREIGN PATENT DOCUMENTS

| | | | |
|---|---|---|---|
| JP | 2000-511263 | A | 8/2000 |
| WO | 97/45636 | A1 | 12/1997 |

* cited by examiner

*Primary Examiner* — John Kwon
*Assistant Examiner* — Johnny Hoang
(74) *Attorney, Agent, or Firm* — Sughrue Mion, PLLC

(57) ABSTRACT

A power circuit, which supplies plasma energy to a spark plug, includes a DC/DC converter which charges a tank capacitor, a voltage limiting circuit which restricts an output voltage of the converter to a predetermined value, a PJ capacitor which is connected to the output side of the converter and is charged by the tank capacitor, and a high breakdown voltage switch which is connected between the PJ capacitor and the DC/DC converter and controls a charging time period of the PJ capacitor in response to operating conditions of an internal combustion engine; and the power circuit switches a voltage limiting value of the tank capacitor for charging the PJ capacitor in synchronization with a driving signal of the high breakdown voltage switch.

4 Claims, 11 Drawing Sheets

IGNITION DEVICE FOR INTERNAL COMBUSTION ENGINE

BACKGROUND OF THE INVENTION

1. Field of the Invention

The present invention relates to plasma ignition devices for use in ignition of internal combustion engines and, more particularly, relates to an ignition device for an internal combustion engine equipped with a power circuit which can charge a PJ capacitor to a target charging voltage within a predetermined time even in the case where a charging time period of the PJ capacitor is short and a capacitance value thereof is large.

2. Description of the Related Art

A known plasma ignition system, which ejects plasma jets in a compressed air-fuel mixture, includes a tank capacitor which is for charging a plasma jet (hereinafter, only referred to abbreviated as "PJ") capacitor and a current limiting resistor in a power circuit of a plasma ignition device and gives large ignition energy to the compressed air-fuel mixture in the case of ignition to improve ignition quality. (For example, see Patent Document 1.)

[Patent Document 1] Japanese Translation of PCT International Application No. 2000-511263

In the foregoing plasma ignition device, there is a problem in that a charging time period of the PJ capacitor in the power circuit is short during engine high rotation and, more particularly, the PJ capacitor cannot be charged to the target charging voltage in the case where a capacitance value of the PJ capacitor is large; and therefore, required plasma energy cannot be satisfied.

FIG. 10 shows a circuit diagram of the known plasma ignition device disclosed in the aforementioned Patent Document 1; FIG. 11 shows its timing chart; and the foregoing problem will be described based on the principle of operation.

In FIG. 10 and FIG. 11, when battery power 1 is supplied at time t1, a DC/DC converter 2 in a power circuit 100 starts to operate and charges a tank capacitor 5 and a PJ capacitor 9.

When a charging voltage VC2 of the tank capacitor 5 reaches a voltage limiting value VCL2 of a voltage limiting circuit 3 at time t2, the operation of the DC/DC converter 2 is made to stop.

A high voltage V2 is applied to a spark plug 20 at time t3; accordingly, a dielectric breakdown is generated between electrodes, plasma energy is given from the power circuit 100 to discharge space where impedance is lowered due to starting of discharge, and plasma is ejected; and therefore, a plasma current PJ-I1 flows. The plasma current PJ-I1 flows; and accordingly, electric charge charged in the PJ capacitor 9 is discharged and a charging voltage VC1 becomes 0 V.

After that, when an operation mode is switched to a high rotation mode at time t4, as described above, the plasma current PJ-I1 flows; and accordingly, the electric charge charged in the PJ capacitor 9 is discharged and the charging voltage VC1 becomes 0 V at time t5. After that, the tank capacitor 5 and the PJ capacitor 9 are charged at time t5 to t6; however, an ignition cycle becomes short because of the high rotation mode; that is, the charging time periods of the tank capacitor 5 and the PJ capacitor 9 become short, and the charging voltage VC2 of the tank capacitor 5 cannot reach the voltage limiting value VCL2 of the voltage limiting circuit 3 at time t6; and accordingly, the charging voltage VC1 of the PJ capacitor 9 cannot also be charged to a target charging voltage VC1*max*. Accordingly, there is a problem in that even when the high voltage V2 is applied to the spark plug 20 at time t6, the dielectric breakdown is generated, and the plasma energy is given from the power circuit 100 to the discharge space where the impedance is lowered due to starting of discharge, the plasma energy in the case of ejecting plasma becomes low with respect to target plasma energy.

BRIEF SUMMARY OF THE INVENTION

The present invention has been made to solve the aforementioned problem, and an object of the present invention is to provide an ignition device for an internal combustion engine which improves a function of a power circuit of a plasma ignition system, which accelerates the charging speed of a PJ capacitor in the case when a high breakdown voltage switch is turned ON and can charge the PJ capacitor to a target charging voltage within a predetermined time even in the case where a charging time period of the PJ capacitor is short and a capacitance value thereof is large.

Furthermore, another object of the present invention is to provide an ignition device for an internal combustion engine in which a voltage limiting value of a tank capacitor at the time when a high breakdown voltage switch is OFF is set in multiple steps, whereby the voltage limiting value of the tank capacitor is switched in response to engine rotational frequency, operation time of a DC/DC converter in a power circuit is reduced during low rotation, and circuit consumption current and heat generation can be suppressed.

According to the present invention, there is provided an ignition device for an internal combustion engine which includes: a plasma discharge type spark plug; an ignition coil which supplies a discharge voltage to the spark plug on the basis of an ignition signal; and a power circuit which is connected in parallel to the spark plug, and supplies plasma energy for generating plasma in discharge space of the spark plug at the time of starting of discharge of the spark plug. The power circuit includes: a DC/DC converter which is connected to DC power, and outputs a DC voltage; a PJ capacitor which is connected to the output side of the DC/DC converter, and charges the plasma energy for generating the plasma in the discharge space of the spark plug; a tank capacitor which is charged by the output of the DC/DC converter, and charges the PJ capacitor at a predetermined time; a voltage limiting circuit in which a plurality of different voltage limiting values for setting a charging voltage of the tank capacitor are set, and which restricts an output voltage of the DC/DC converter to a predetermined value; and a high breakdown voltage switch which is provided between the tank capacitor and the PJ capacitor, and in which ON/OFF control is performed by a driving signal corresponding to an operation state of the internal combustion engine to control a charging time period of the PJ capacitor. The voltage limiting circuit switches set values of the voltage limiting values by a control signal synchronized with the driving signal of the high breakdown voltage switch.

Furthermore, the voltage limiting circuit sets the voltage limiting value at the time when the high breakdown voltage switch is OFF in multiple steps and switches the voltage limiting value in response to engine rotational frequency.

According to an ignition device for an internal combustion engine of the present invention, the charging speed of a PJ capacitor in the case when a high breakdown voltage switch is turned ON can be accelerated and a PJ capacitor can be charged to a target charging voltage within a predetermined time even in the case where a charging time period of the PJ capacitor is short and a capacitance value thereof is large.

Furthermore, a voltage limiting circuit sets a voltage limiting value at the time when a high breakdown voltage switch is OFF in multiple steps and switches the voltage limiting value in response to engine rotational frequency; whereby operation time of a DC/DC converter in a power circuit can be reduced during low rotation and circuit consumption current and heat generation can be suppressed.

The foregoing and other object, features, and advantages of the present invention will become more apparent from the following detailed description of preferred embodiments and description shown in the accompanying drawings.

DETAILED DESCRIPTION OF THE INVENTION

Figure 1:
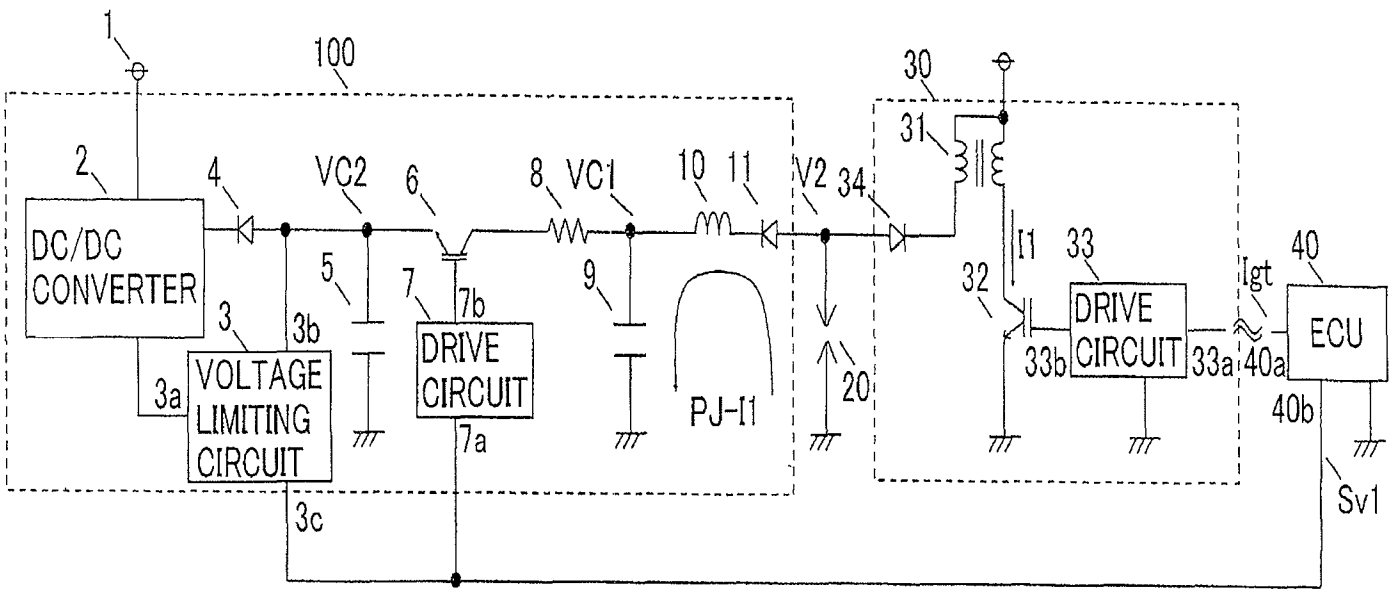
FIG. 1 is a circuit diagram showing the configuration of an ignition device for an internal combustion engine according to a preferred embodiment 1 of the present invention.

Hereinafter, preferred embodiments of the present invention will be described in detail with reference to drawings. Incidentally, the same reference numerals as those shown in the respective drawings represent the same or corresponding elements.

Preferred Embodiment 1

FIG. 1 is a circuit configuration diagram of an ignition device for an internal combustion engine of a preferred embodiment 1 of the present invention. In the drawing, the ignition device for the internal combustion engine of the preferred embodiment 1 is composed of a spark plug 20, an ignition circuit 30 which generates a high voltage on the basis of an ignition signal Igt from an electronic control unit (referred to as "ECU") 40 in order to generate discharge in discharge space of the spark plug 20, and a power circuit 100 which generates a plasma current PJ-I1 in order to eject plasma by giving plasma energy to discharge space where impedance is lowered due to starting of discharge.

The ignition circuit 30 and the power circuit 100 are connected in parallel to each other with respect to the spark plug 20.

The power circuit 100 that is a major portion of the present invention includes a DC/DC converter 2, a voltage limiting circuit 3, a rectifying diode 4, a tank capacitor 5, a high breakdown voltage switch 6 (in this case, an insulated gate bipolar transistor (referred to as "IGBT") and it will not be repeated later), a drive circuit 7, a current limiting resistor 8, a PJ capacitor 9, an inductor 10, and a high voltage diode 11.

The DC/DC converter 2 is connected to an output terminal 3*a* of the voltage limiting circuit 3 and to the cathode side of the rectifying diode 4. The anode side of the rectifying diode 4 is connected to an input terminal 3*b* of the voltage limiting circuit 3, to the high voltage side of the tank capacitor 5, and to an emitter of the high breakdown voltage switch 6. The other end of the tank capacitor 5 is connected to a ground (referred to as "GND"). A gate of the high breakdown voltage switch 6 is connected to an output terminal 7*b* of the drive circuit 7 and a collector thereof is connected to the current limiting resistor 8.

An input terminal 7*a* of the drive circuit 7 is connected to an input terminal 3*c* of the voltage limiting circuit 3 and to an output terminal 40*b* of the ECU 40. The other end of the current limiting resistor 8 is connected to the high voltage side of the PJ capacitor 9 and to the inductor 10. The other end of the PJ capacitor 9 is connected to the GND.

Furthermore, the other end of the inductor 10 is connected to the cathode side of the high voltage diode 11, and the anode side of the high voltage diode 11 is connected to the spark plug 20.

Figure 2:
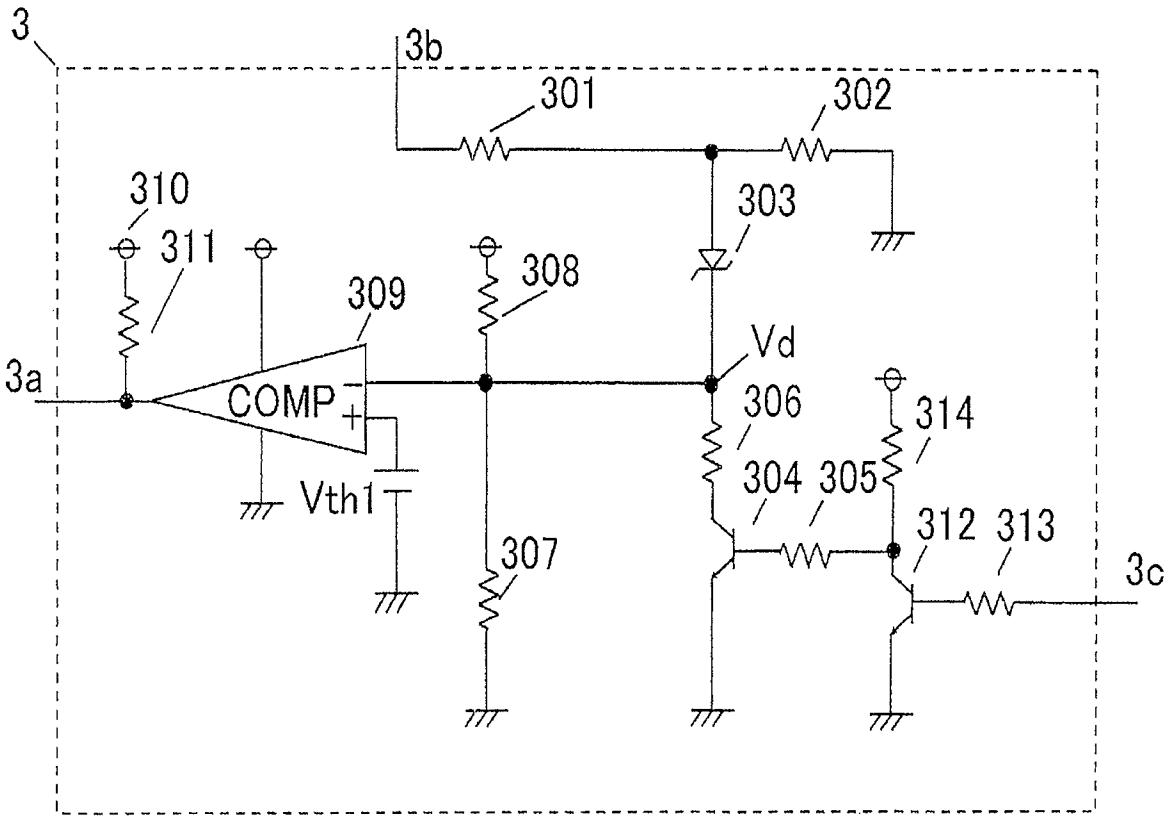
FIG. 2 is a circuit diagram showing the configuration of a voltage limiting circuit according to the preferred embodiment 1 of the present invention.

Next, a circuit configuration diagram of the voltage limiting circuit 3 is shown in FIG. 2.

In FIG. 2, a voltage limiting value of the voltage limiting circuit 3 is set to a first voltage limiting value VCL2 and a second voltage limiting value VCL2' (|VCL2|>|VC2'|).

During a time period when a Low voltage signal is inputted from the ECU 40 to the input terminal 3*c* of the voltage limiting circuit 3 as a control command signal Sv1 in response to operating conditions of the internal combustion engine, a transistor 304 in the voltage limiting circuit 3 is in an ON state; and a comparator 309 compares a detection voltage Vd in which a charging voltage VC2 of the tank capacitor 5 is detected by resistors 301, 302, 306, 307, and 308 and a Zener diode 303 with a reference voltage Vth1. When the detection voltage Vd becomes less than the reference voltage Vth1, that is, the charging voltage VC2 of the tank capacitor 5 becomes the first set voltage VCL2, the comparator 309 supplies a High voltage detection signal from the output terminal 3*a* of the voltage limiting circuit 3 to the DC/DC converter 2. Accordingly, the operation of the DC/DC converter 2 is made to stop.

Furthermore, during a time period when a High voltage signal is inputted from the ECU 40 to the input terminal 3*c* of the voltage limiting circuit 3 as the control command signal Sv1, the transistor 304 in the voltage limiting circuit 3 is in an OFF state and impedance at a point Vd is made to increase with respect to the time when the voltage limiting value is VCL2; and accordingly, the amount of current flowing from the point Vd to the Zener diode 303 is made to increase and the voltage limiting value is made to decrease to VCL2'.

The comparator 309 compares the detection voltage Vd in which the charging voltage VC2 of the tank capacitor 5 is detected by the resistors 301, 302, 307, and 308 and the Zener diode 303 with the reference voltage Vth1. When the detection voltage Vd becomes less than the reference voltage Vth1, that is, the charging voltage VC2 of the tank capacitor 5 becomes the second set voltage VCL2', the comparator 309 supplies the High voltage detection signal from the output terminal 3*a* of the voltage limiting circuit 3 to the DC/DC converter 2. Accordingly, the operation of the DC/DC converter 2 is made to stop.

A High voltage signal Sv1 (for example, it is set to after several hundred μsec from the leading edge of the ignition signal Igt) outputted from the ECU 40 is supplied to the gate via the drive circuit 7 and accordingly the high breakdown voltage switch 6 becomes an ON state; and as described above, the PJ capacitor 9 is charged by the DC/DC converter 2, the tank capacitor 5, and the current limiting resistor 8.

Accordingly, the PJ capacitor 9 is charged only during the timing when the High voltage signal Sv1 is supplied from the ECU 40; and therefore, a time period when the PJ capacitor 9 is charged can be restricted.

The ignition circuit 30 includes an ignition coil 31, a switching element 32 such as the IGBT connected to a primary coil of the ignition coil 31, a drive circuit 33 which makes the switching element 32 operate in response to the ignition signal Igt from the ECU 40, and a rectifying diode 34 connected between a secondary coil of the ignition coil 31 and the spark plug 20. Then, the ignition circuit 30 drives the switching element 32 via the drive circuit 33 in response to the ignition signal Igt from the ECU 40 and switches a primary coil current I1 of the ignition coil 31; and accordingly, a discharge voltage is applied to the spark plug 20 via the rectifying diode 34.

Figure 3:
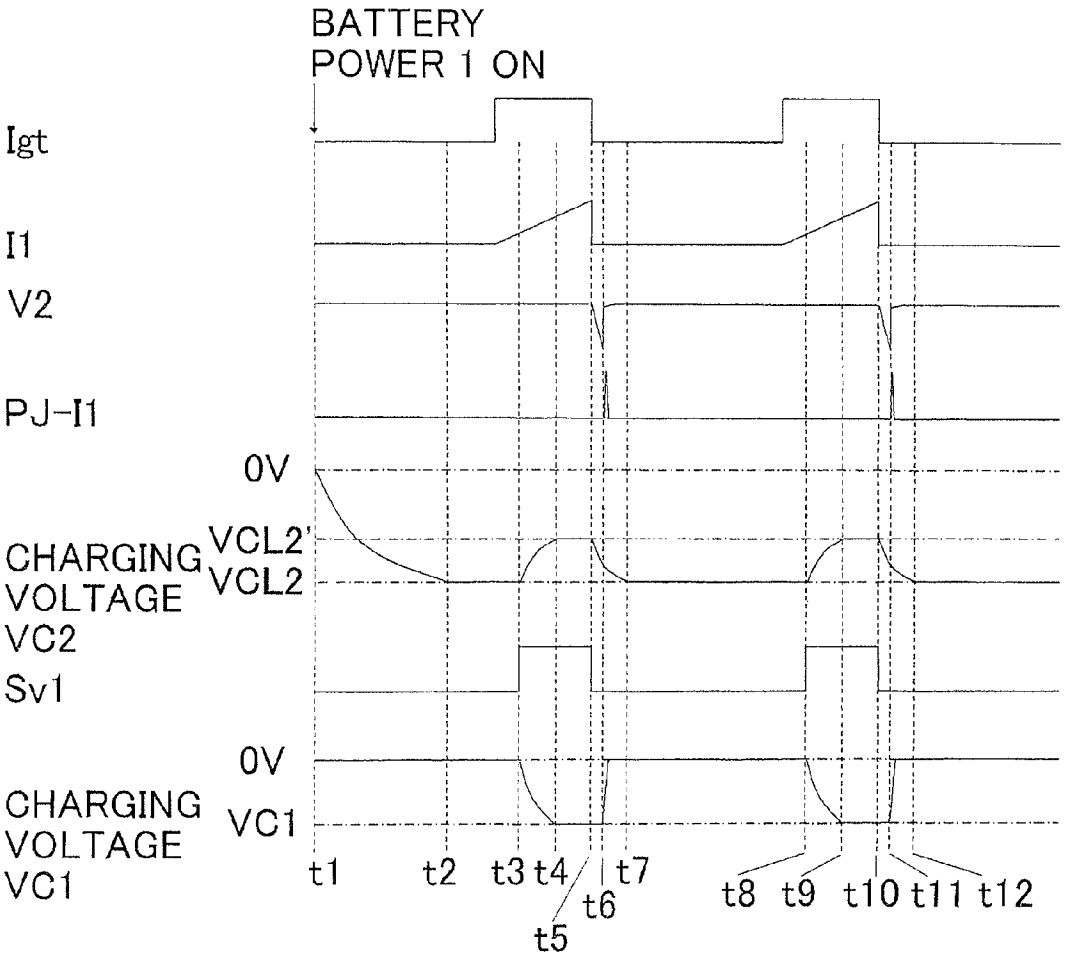
FIG. 3 is a timing chart at each operating point in the ignition device for the internal combustion engine of the preferred embodiment 1 of the present invention.

FIG. 3 shows a timing chart of respective waveforms of the preferred embodiment 1.

When battery power 1 is supplied at time t1, the DC/DC converter 2 in the power circuit 100 starts to operate and charges the tank capacitor 5.

At this time, a Low voltage signal Sv1 is inputted from the ECU 40 to the input terminal 3*c* of the voltage limiting circuit 3 and to the input terminal 7*a* of the drive circuit 7. Accordingly, as described above, a voltage limiting value of the voltage limiting circuit 3 is set to VCL2.

When a charging voltage VC2 of the tank capacitor 5 reaches the voltage limiting value VCL2 of the voltage limiting circuit 3 at time t2, the operation of the DC/DC converter 2 is made to stop.

When a High voltage signal Sv1 is inputted (for example, it is set to after several hundred μsec from the leading edge of an ignition signal Igt) from the ECU 40 to the input terminal 3*c* of the voltage limiting circuit 3 and to the input terminal 7*a* of the drive circuit 7 at time t3, as described above, the voltage limiting value of the voltage limiting circuit 3 is switched to VCL2' that is set slightly higher than a target charging voltage VC1*max* of the PJ capacitor 9 for overvoltage prevention of the PJ capacitor 9; and the high breakdown voltage switch 6 becomes an ON state and charging is started from the tank capacitor 5 to the PJ capacitor 9.

A charging voltage VC1 of the PJ capacitor 9 reaches the target charging voltage VC1*max* and the charging voltage VC2 of the tank capacitor 5 reaches the voltage limiting value VCL2' of the voltage limiting circuit 3 at time t4.

When the voltage signal Sv1 is switched to Low (for example, it is set to the same time as the trailing edge of the ignition signal Igt) at time t5, as described above, the voltage limiting value of the voltage limiting circuit 3 is switched to VCL2 and charging of the tank capacitor 5 is started.

A high voltage V2 is applied to the spark plug 20 at time t6; accordingly, a dielectric breakdown is generated between electrodes of the spark plug, plasma energy is given from the power circuit 100 to discharge space where impedance is lowered due to starting of discharge, and plasma is ejected; and therefore, a plasma current PJ-I1 flows.

The plasma current PJ-I1 flows; and accordingly, electric charge charged in the PJ capacitor 9 is discharged and the charging voltage VC1 becomes 0V. Thereafter, this operation will be repeated at time t7 to t12.

As described above, according to the preferred embodiment 1 of the present invention, even in the case where the high breakdown voltage switch 6 in the power circuit 100 of the plasma ignition device is controlled by a short time driving signal (High signal) and a capacitance value of the PJ capacitor 9 is large, the voltage limiting value VCL2 of the tank capacitor 5 at the time when the high breakdown voltage switch 6 is OFF (the ignition signal is at Low) is set to be higher as an absolute value than the voltage limiting value VCL2' at ON; and accordingly, the charging speed of PJ capacitor 9 in the case when the high breakdown voltage switch 6 is turned ON can be accelerated and the PJ capacitor 9 can be charged to the target charging voltage within a predetermined time (ON time period of the high breakdown voltage switch 6).

Furthermore, when the high breakdown voltage switch 6 is turned ON, the voltage limiting value of the tank capacitor 5 is switched to VCL2'; and accordingly, the charging voltage VC1 of the PJ capacitor 9 is maintained at the target charging voltage VC1*max* and can be prevented from being an overvoltage.

Incidentally, FIG. 1 shows an example where the high voltage diode 11 and the rectifying diode 34 are arranged in a direction in which a central electrode of the spark plug 20 is a cathode; however, the high voltage diode 11 and the rectifying diode 34 may be arranged in a direction in which the central electrode of the spark plug 20 is an anode.

Preferred Embodiment 2

Figure 4:
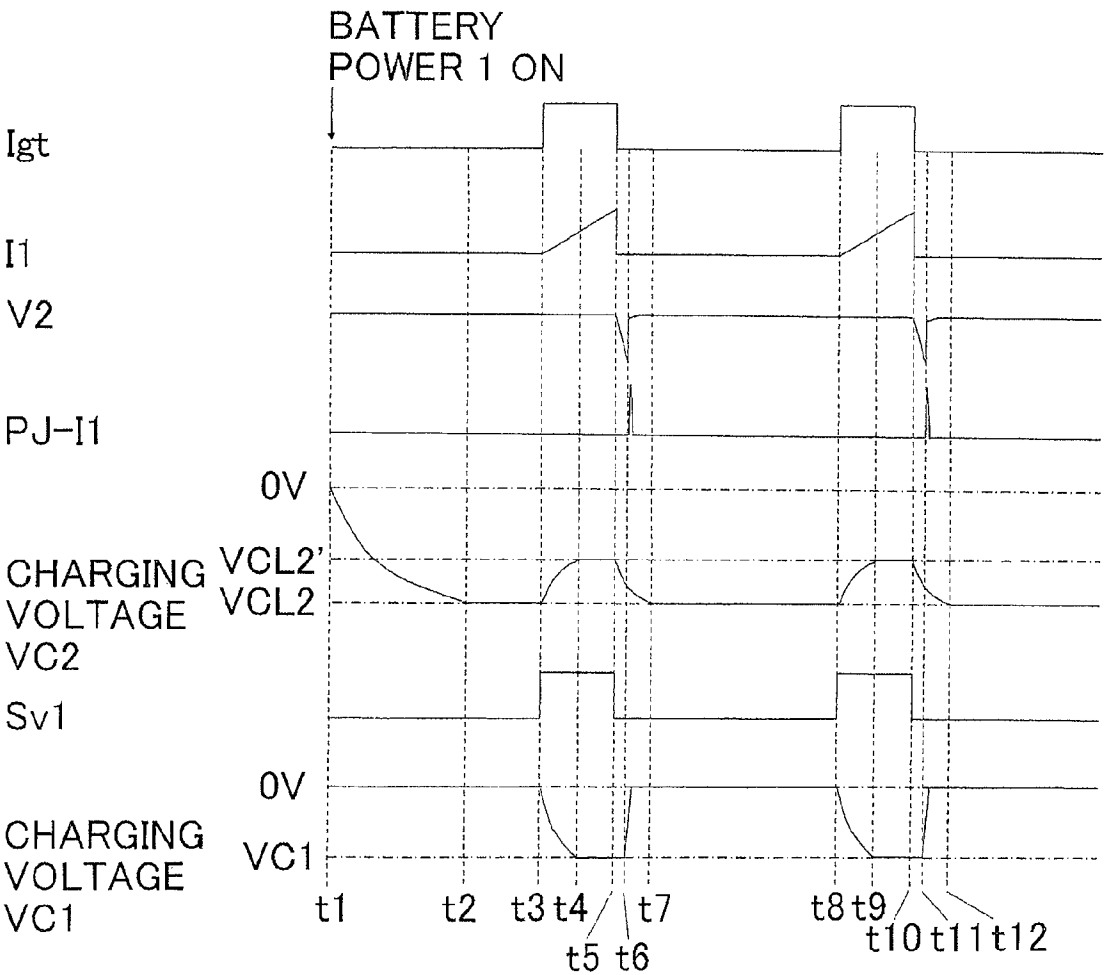
FIG. 4 is a timing chart at each operating point in an ignition device for an internal combustion engine of a preferred embodiment 2 of the present invention.

In an ignition device for an internal combustion engine of a preferred embodiment 2 of the present invention, a voltage signal Sv1 outputted from an ECU 40 serves as an ignition signal Igt in the configuration of the preferred embodiment 1 in FIG. 1, and a timing chart at each operating point of the preferred embodiment 2 is shown in FIG. 4. Incidentally, the principle of operation is the same as that of the aforementioned preferred embodiment 1 and therefore description thereof will not be repeated.

Also in the preferred embodiment 2, as in the preferred embodiment 1, there is an effect that the charging speed of a PJ capacitor in the case when a high breakdown voltage switch is turned ON can be accelerated without changing a target charging voltage (target PJ energy) of the PJ capacitor 9.

Preferred Embodiment 3

Figure 5:
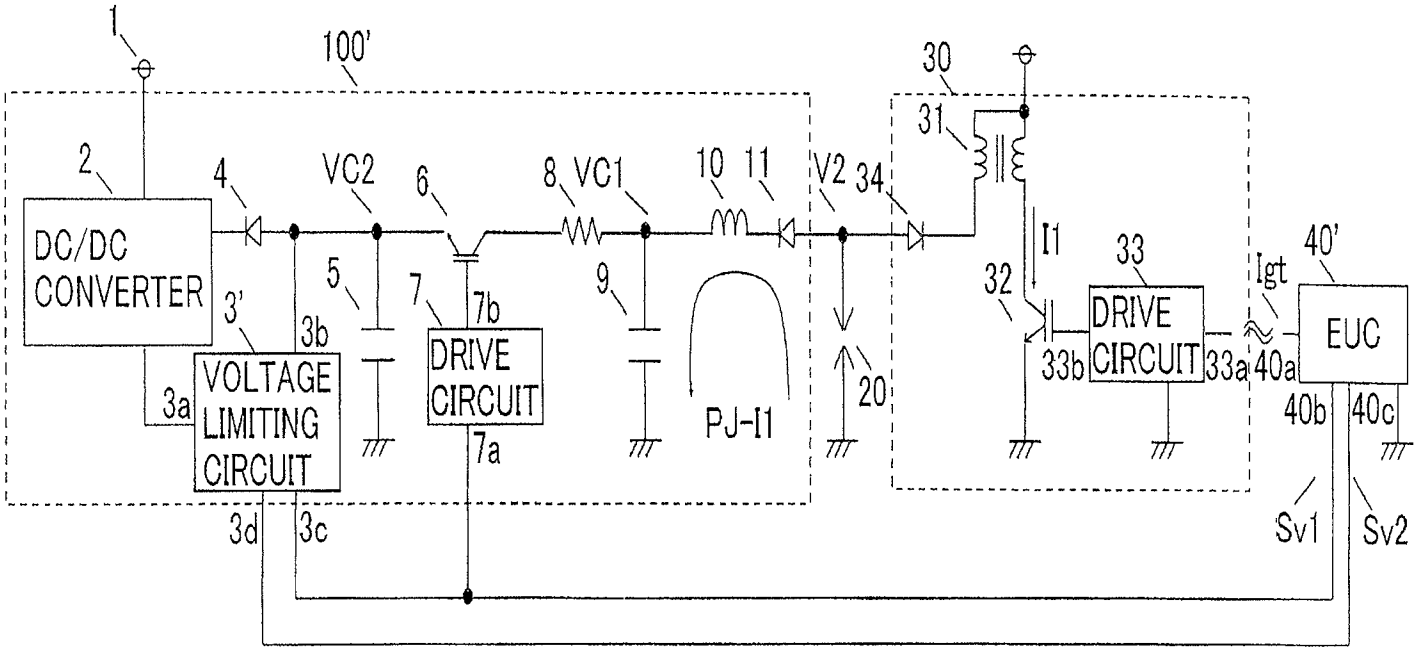
FIG. 5 is a circuit diagram showing the configuration of an ignition device for an internal combustion engine according to a preferred embodiment 3 of the present invention.

FIG. 5 is a circuit configuration diagram of an ignition device for an internal combustion engine of a preferred embodiment 3 of the present invention.

With respect to the plasma ignition device of the preferred embodiment 1 shown in FIG. 1, a plasma ignition device of the preferred embodiment 3 is further provided with an input terminal 3*d* on a voltage limiting circuit 3 and an output terminal 40*c* on an ECU 40 and a voltage signal Sv2 is further inputted from the output terminal 40*c* of the ECU 40 to the input terminal 3*d* of the voltage limiting circuit 3; and accordingly, a voltage limiting value of a tank capacitor 5 at the time when a high breakdown voltage switch 6 is OFF is set in multiple steps (plural numbers), and this configuration is denoted as a voltage limiting circuit 3', a power circuit 100', and an ECU 40'. Incidentally, other configuration is the same as that of the preferred embodiment 1 and therefore description thereof will not be repeated.

Next, the voltage limiting circuit 3' in the preferred embodiment 3 will be described with reference to the circuit configuration diagram of FIG. 6.

Figure 6:
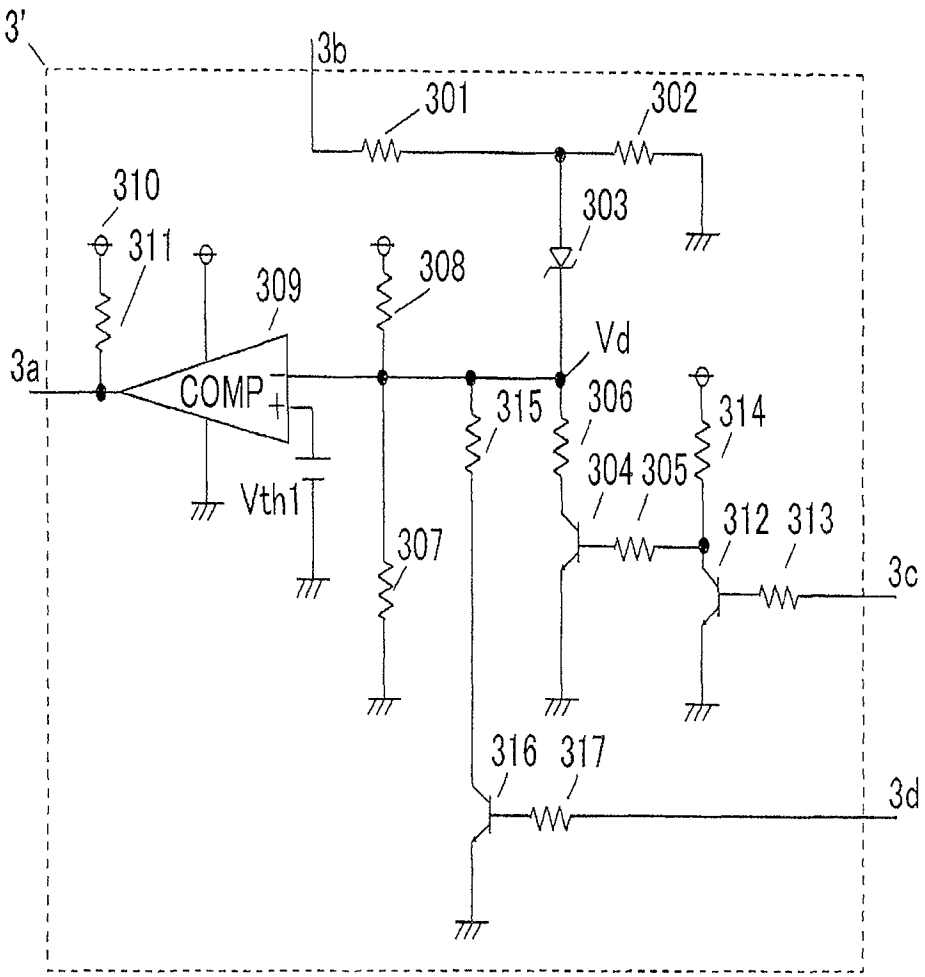
FIG. 6 is a circuit diagram showing the configuration of a voltage limiting circuit according to the preferred embodiment 3 of the present invention.

In FIG. 6, the voltage limiting value of the voltage limiting circuit 3' is set to a first voltage limiting value VCL3, a second voltage limiting value VCL3', and a third voltage limiting value VCL3" (|VCL3"|>|VCL3|>|VCL3'|).

During time periods when a Low voltage signal is inputted to an input terminal 3*c* of the voltage limiting circuit 3' as a control command signal Sv1 and a Low voltage signal is inputted to the input terminal 3*d* of the voltage limiting circuit 3' as a control command signal Sv2 from the ECU 40' in response to operating conditions of the internal combustion engine, a transistor 304 in the voltage limiting circuit 3' is in an ON state and a transistor 316 therein is in an OFF state. Therefore, a comparator 309 compares a detection voltage Vd in which a charging voltage VC2 of the tank capacitor 5 is detected by resistors 301, 302, 306, 307, and 308 and a Zener diode 303 with a reference voltage Vth1.

When the detection voltage Vd becomes less than the reference voltage Vth1, that is, the charging voltage VC2 of the tank capacitor 5 becomes the first set voltage VCL3, the comparator 309 supplies a High voltage detection signal from an output terminal 3*a* of the voltage limiting circuit 3' to a DC/DC converter 2.

Accordingly, the operation of the DC/DC converter 2 is made to stop.

Furthermore, during time periods when a High voltage signal is inputted to the input terminal 3*c* of the voltage limiting circuit 3' as the control command signal Sv1 and the Low voltage signal is inputted to the input terminal 3*d* of the voltage limiting circuit 3' as the control command signal Sv2 from the ECU 40', the transistor 304 in the voltage limiting circuit 3' is in an OFF state, the transistor 316 is in an OFF state, and impedance at a point Vd is made to increase with respect to the time when the voltage limiting value is VCL3; and accordingly, the amount of current flowing from the point Vd to the Zener diode 303 is made to increase and the voltage limiting value is made to decrease to VCL3'. Therefore, the comparator 309 compares a detection voltage Vd in which the charging voltage VC2 of the tank capacitor 5 is detected by the resistors 301, 302, 307, and 308 and the Zener diode 303 with the reference voltage Vth1.

When the detection voltage Vd becomes less than the reference voltage Vth1, that is, the charging voltage VC2 of the tank capacitor 5 becomes the second set voltage VCL3', the comparator 309 supplies a High voltage detection signal from the output terminal 3*a* of the voltage limiting circuit 3' to the DC/DC converter 2.

Accordingly, the operation of the DC/DC converter 2 is made to stop.

In addition, in the case of high rotation condition where a time period of High of an ignition signal Igt is short, when the high breakdown voltage switch 6 is in an OFF state, that is, during time periods when a Low voltage signal is inputted to the input terminal 3*c* of the voltage limiting circuit 3' as the control command signal Sv1 and a High voltage signal is inputted to the input terminal 3*d* of the voltage limiting circuit 3' as the control command signal Sv2, the transistor 304 in the voltage limiting circuit 3' is in an ON state and the transistor 316 therein is in an OFF state. Then, impedance at the point of Vd is made to decrease with respect to the time when the voltage limiting value is VCL3; and accordingly, the amount of current flowing from the point Vd to the Zener diode 303 is made to decrease and the voltage limiting value is made to increase to VCL3". Therefore, the comparator 309 compares a detection voltage Vd in which the charging voltage VC2 of the tank capacitor 5 is detected by resistors 301, 302, 306, 307, 308, and 315 and the Zener diode 303 with the reference voltage Vth1.

When the detection voltage Vd becomes less than the reference voltage Vth1, that is, the charging voltage VC2 of the tank capacitor 5 becomes the third set voltage VCL3", the comparator 309 supplies a High level voltage detection signal from the output terminal 3*a* of the voltage limiting circuit 3' to the DC/DC converter 2.

Accordingly, the operation of the DC/DC converter 2 is made to stop.

The operation of the high breakdown voltage switch 6, the PJ capacitor 9, and the ignition circuit 30 is the same as that of the preferred embodiment 1 and therefore description thereof will not be repeated.

Figure 7:
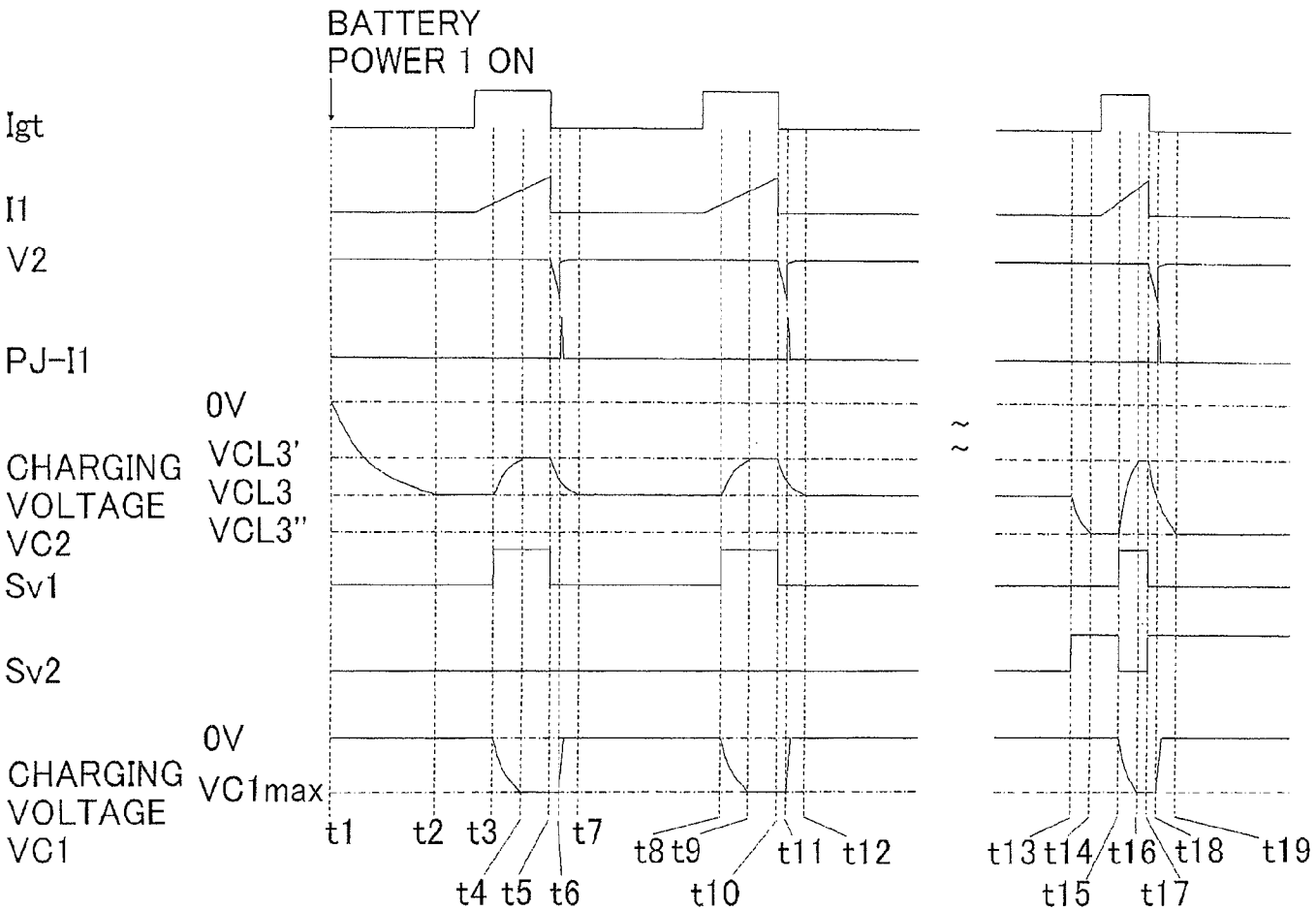
FIG. 7 is a timing chart at each operating point in the ignition device for the internal combustion engine of the preferred embodiment 3 of the present invention.

FIG. 7 shows a timing chart of respective waveforms of the preferred embodiment 3.

When battery power 1 is supplied at time t1, the DC/DC converter 2 in the power circuit 100' starts to operate and charges the tank capacitor 5. At this time, from the ECU 40', a Low voltage signal Sv1 is inputted to the input terminal 3*c* of the voltage limiting circuit 3' and to an input terminal 7*a* of a drive circuit 7, and a Low voltage signal Sv2 is inputted to the input terminal 3*d* of the voltage limiting circuit 3'. Accordingly, as described above, a voltage limiting value of the voltage limiting circuit 3' is set to VCL3.

When a charging voltage VC2 of the tank capacitor 5 reaches the voltage limiting value VCL3 of the voltage limiting circuit 3' at time t2, the operation of the DC/DC converter 2 is made to stop.

When a High voltage signal Sv1 (for example, it is set to after several hundred μsec from the leading edge of an ignition signal Igt) is inputted to the input terminal 3*c* of the voltage limiting circuit 3' and to the input terminal 7*a* of the drive circuit 7, and the Low voltage signal Sv2 is inputted to the input terminal 3*d* of the voltage limiting circuit 3', from the ECU 40' at time t3; as described above, the voltage limiting value of the voltage limiting circuit 3' is switched to VCL3'; and the high breakdown voltage switch 6 becomes an ON state and charging is started from the tank capacitor 5 to the PJ capacitor 9.

A charging voltage VC1 of the PJ capacitor 9 reaches a target charging voltage VC1*max* and the charging voltage VC2 of the tank capacitor 5 reaches the voltage limiting value VCL3' of the voltage limiting circuit 3' at time t4.

When the voltage signal Sv1 is switched to Low (for example, it is set to the same time as the trailing edge of the ignition signal Igt) at time t5, as described above, the voltage limiting value of the voltage limiting circuit 3' is switched to VCL3 and charging of the tank capacitor 5 is started.

When a high voltage V2 is applied to a spark plug 20 at time t6, a dielectric breakdown is generated between electrodes of the spark plug, plasma energy is given from the PJ capacitor 9 of the power circuit 100' to discharge space where impedance is lowered due to starting of discharge, and plasma is ejected; and therefore, a plasma current PJ-I1 flows. The plasma current PJ-I1 flows and accordingly electric charge charged in the PJ capacitor 9 is discharged and the charging voltage VC1 becomes 0 V.

Thereafter, this operation will be repeated at time t7 to t12.

After that, when an operation mode is switched to a high rotation mode at time t13, the Low voltage signal Sv1 is inputted to the input terminal 3*c* of the voltage limiting circuit 3' and to the input terminal 7*a* of the drive circuit 7, and a High voltage signal Sv2 is inputted to the input terminal 3*d* of the voltage limiting circuit 3', from the ECU 40'. Accordingly, as described above, the voltage limiting value of the voltage limiting circuit 3' is set to the aforementioned VCL3".

When the charging voltage VC2 of the tank capacitor 5 reaches the voltage limiting value VCL3" of the voltage limiting circuit 3' at time t14, the operation of the DC/DC converter 2 is made to stop.

When the High voltage signal Sv1 (for example, it is set to after several hundred μsec from the leading edge of the ignition signal Igt) is inputted to the input terminal 3*c* of the voltage limiting circuit 3' and to the input terminal 7*a* of the drive circuit 7, and the Low voltage signal Sv2 is inputted to the input terminal 3*d* of the voltage limiting circuit 3', from the ECU 40' at time t15; as described above, the voltage limiting value of the voltage limiting circuit 3' is switched to VCL3', the high breakdown voltage switch 6 becomes an ON state, and charging is started from the tank capacitor 5 to the PJ capacitor 9.

The charging voltage VC1 of the PJ capacitor 9 reaches the target charging voltage VC1*max* and the charging voltage VC2 of the tank capacitor 5 reaches the voltage limiting value VCL3' of the voltage limiting circuit 3' at time t16.

When the voltage signal Sv1 is switched to Low and the voltage signal Sv2 is switched to High (for example, it is set to the same time as the trailing edge of the ignition signal Igt) at time t17, as described above, the voltage limiting value of the voltage limiting circuit 3' is switched to VCL3" and charging of the tank capacitor 5 is started.

As for operation from time t18 to t19, the operation is the same as that of the preferred embodiment 1 and therefore description thereof will not be repeated.

As described above, according to the ignition device for the internal combustion engine of the preferred embodiment 3 of the present invention, in addition to the same effect as that of the preferred embodiment 1, the voltage limiting value of the tank capacitor 5 at the time when the high breakdown voltage switch 6 in the power circuit 100' is OFF is set in multiple steps and the voltage limiting value of the tank capacitor 5 is switched in response to engine rotational frequency; and accordingly, a High time period of an ignition signal is long during low rotation and therefore the voltage limiting value of the tank capacitor 5 is set to be lower than that during high rotation, whereby there is an effect in that operation time of the DC/DC converter 2 in the power circuit 100' is decreased and circuit consumption current and heat generation can be suppressed.

Incidentally, FIG. 5 shows an example where a high voltage diode 11 and a rectifying diode 34 are arranged in a direction in which a central electrode of the spark plug 20 is a cathode; however, the high voltage diode 11 and the rectifying diode 34 may be arranged in a direction in which the central electrode of the spark plug 20 is an anode.

Preferred Embodiment 4

Figure 8:
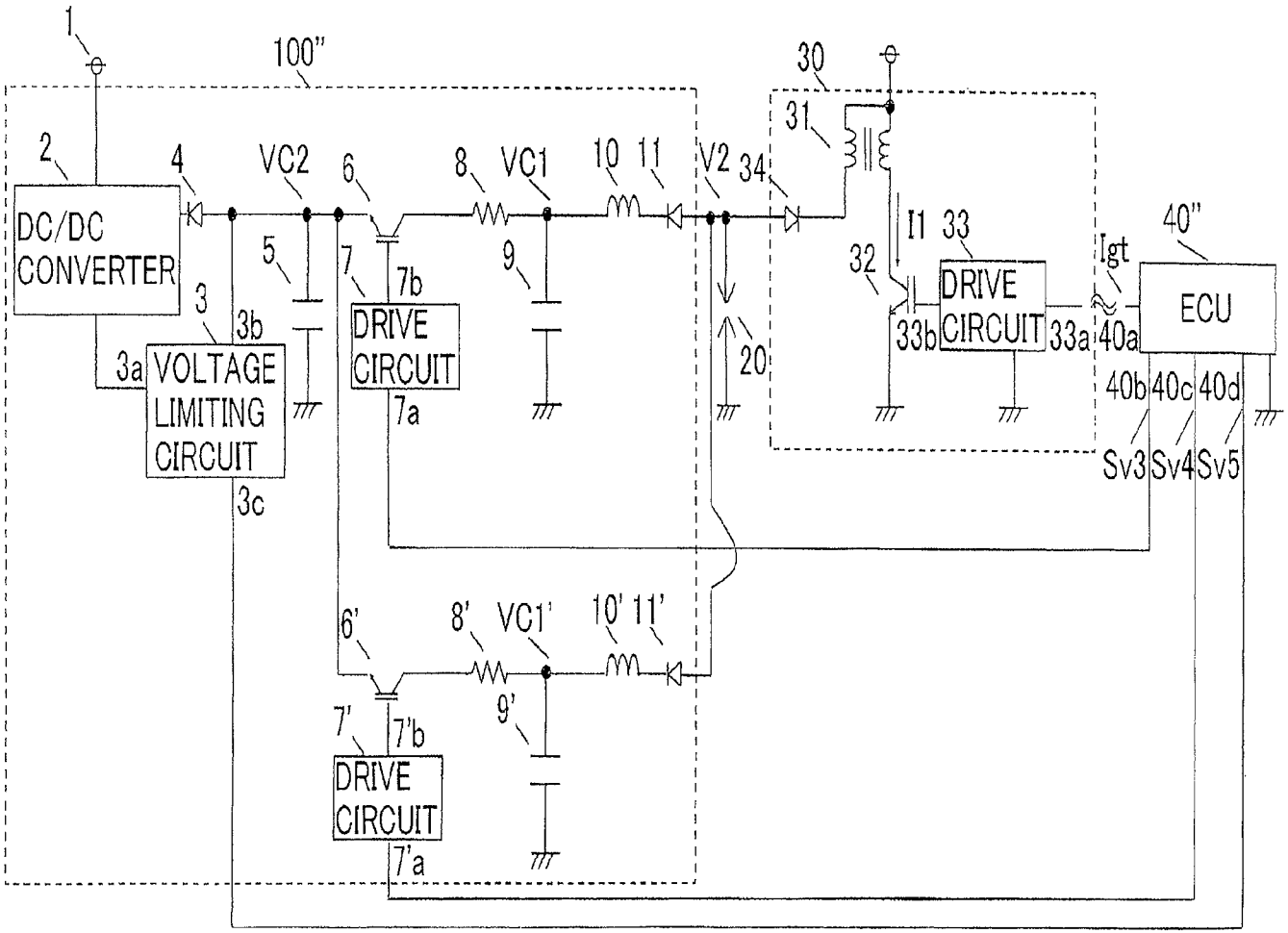
FIG. 8 is a circuit diagram showing the configuration of an ignition device for an internal combustion engine according to a preferred embodiment 4 of the present invention.

FIG. 8 is a circuit configuration diagram of an ignition device for an internal combustion engine of a preferred embodiment 4 of the present invention.

With respect to the plasma ignition device of the preferred embodiment 1 shown in FIG. 1, a plasma ignition device of the preferred embodiment 4 is further provided with output terminals 40*c* and 40*d* on an ECU 40, and this configuration is denoted as an ECU 40"; two sets of high breakdown voltage switches 6 and 6', drive circuits 7 and 7', current limiting resistors 8 and 8', PJ capacitors 9 and 9', inductors 10 and 10', and high voltage diodes 11 and 11' are arranged in the power circuit 100, respectively, and this configuration is denoted as a power circuit 100"; and a capacitance value of the PJ capacitor 9 is set to be larger than a capacitance value of the PJ capacitor 9'.

Furthermore, a control command signal Sv3 or Sv4 is selectively inputted from an output terminal 40*b* or 40*c* of the ECU 40" to an input terminal 7*a* or 7'*a* of the drive circuit 7 or 7' in response to operating conditions; and accordingly, the PJ capacitor 9 or the PJ capacitor 9' is selected and plasma energy is made to be variable. Then, a control command signal Sv5 is inputted from the output terminal 40*d* of the ECU 40" to an input terminal 3*c* of a voltage limiting circuit 3 in response to the selected PJ capacitor 9 or PJ capacitor 9'; and accordingly, a voltage limiting value of a tank capacitor 5 at the time when the high breakdown voltage switches 6 or 6' is OFF is made to be variable.

Furthermore, the voltage limiting circuit 3 is the same as that described in FIG. 2 and other configuration is also the same as that of the preferred embodiment 1; and therefore, description thereof will not be repeated.

Figure 9:
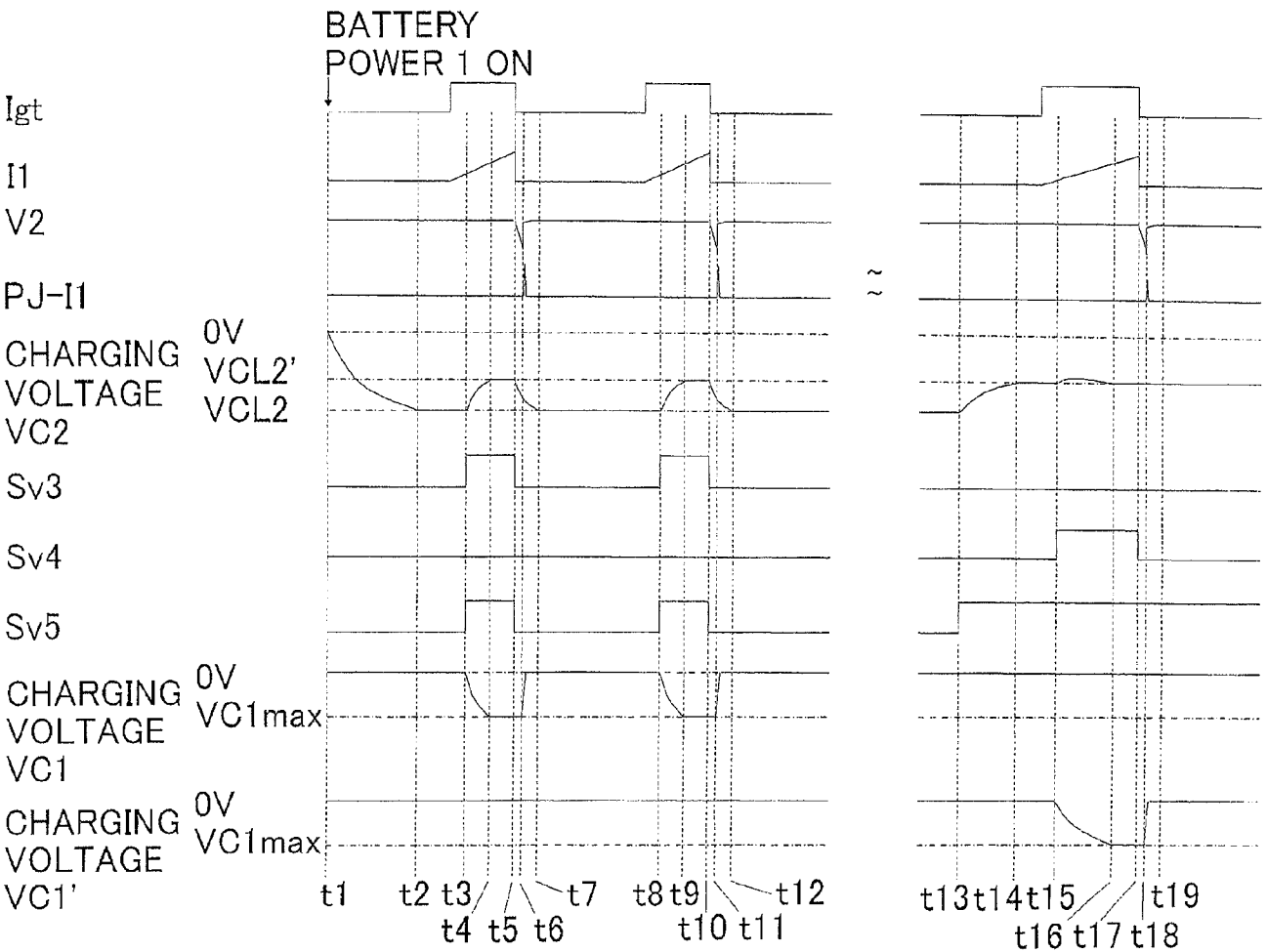
FIG. 9 is a timing chart at each operating point in the ignition device for the internal combustion engine of the preferred embodiment 4 of the present invention.
Figure 10:
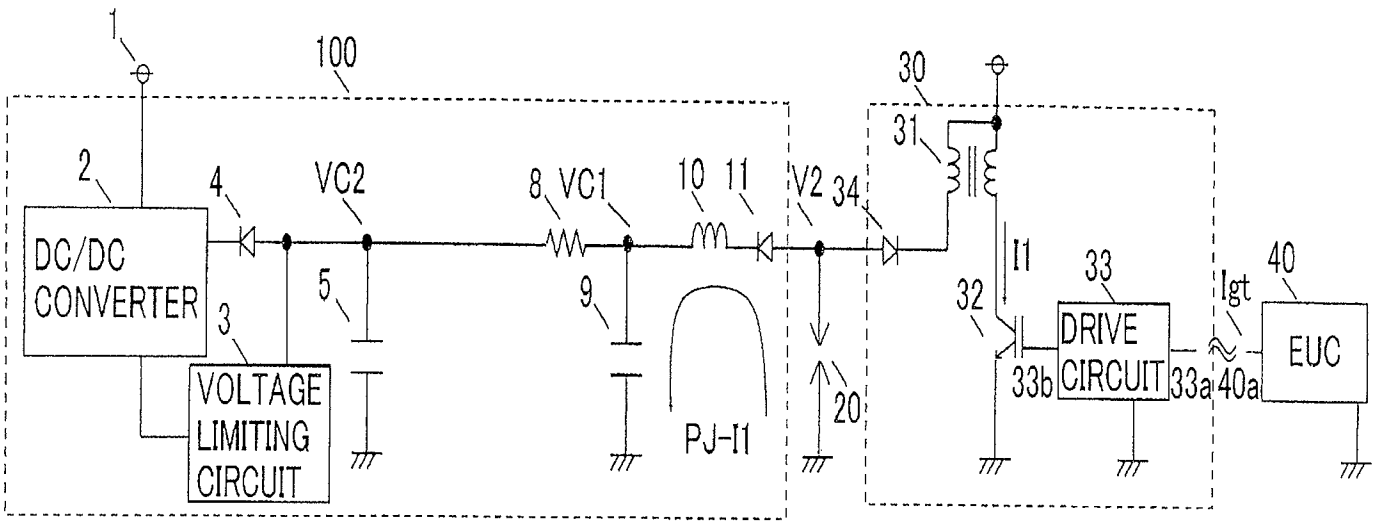
FIG. 10 is a circuit diagram showing a known plasma ignition device.
Figure 11:
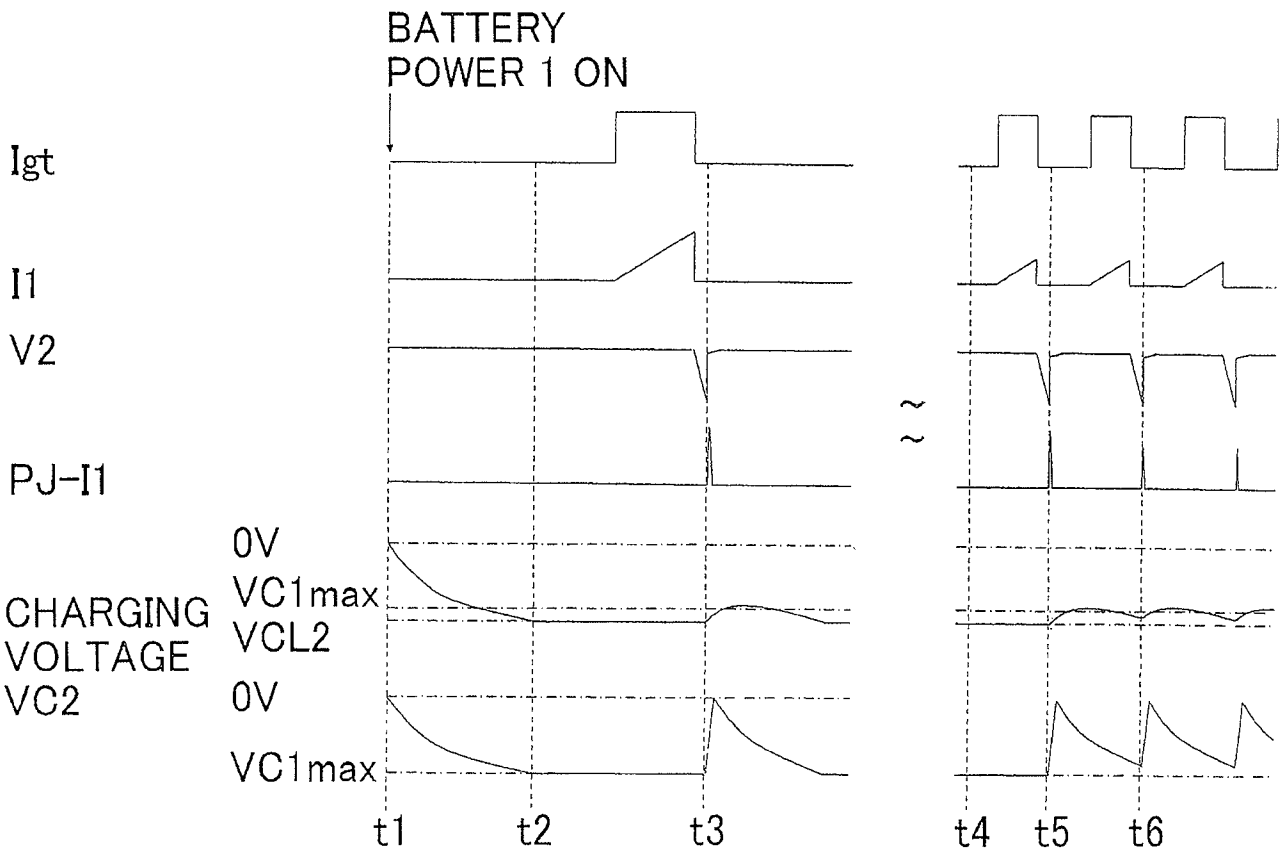
FIG. 11 is a timing chart at each operating point of the known plasma ignition device.

FIG. 9 shows a timing chart of respective waveforms of the preferred embodiment 4 of the present invention.

When battery power 1 is supplied at time t1, a DC/DC converter 2 in the power circuit 100" starts to operate and charges the tank capacitor 5.

At this time, from the ECU 40", a Low voltage signal Sv3, Sv4, or Sv5 is inputted to the input terminal 7*a* or 7'*a* of the drive circuit 7 or 7' and to the input terminal 3*c* of the voltage limiting circuit 3, respectively. Furthermore, as in the operation of the preferred embodiment 1, the voltage limiting value of the voltage limiting circuit 3 is set to VCL2.

When a charging voltage VC2 of the tank capacitor 5 reaches the voltage limiting value VCL2 of the voltage limiting circuit 3 at time t2, the operation of the DC/DC converter 2 is made to stop.

When a High voltage signal Sv5 (for example, it is set to after several hundred μsec from the leading edge of an ignition signal Igt) is inputted to the input terminal 3*c* of the voltage limiting circuit 3, a High voltage signal Sv3 (for example, it is set to after several hundred μsec from the leading edge of the ignition signal Igt) is inputted to the input terminal 7*a* of the drive circuit 7, and a Low voltage signal Sv4 is inputted to the input terminal 7'*a* of the drive circuit 7', from the ECU 40" at time t3; the voltage limiting value of the voltage limiting circuit 3 is switched to VCL2'; and the high breakdown voltage switch 6 becomes an ON state and charging is started from the tank capacitor 5 to the PJ capacitor 9.

A charging voltage VC1 of the PJ capacitor 9 reaches a target charging voltage VC1*max* and the charging voltage VC2 of the tank capacitor 5 reaches the voltage limiting value VCL2' of the voltage limiting circuit 3 at time t4.

When the voltage signals Sv3 and Sv5 are switched to Low (for example, it is set to the same time as the trailing edge of the ignition signal Igt) at time t5, the voltage limiting value of the voltage limiting circuit 3 is switched to the VCL2 and charging of the tank capacitor 5 is started.

When a high voltage V2 is applied to a spark plug 20 at time t6, a dielectric breakdown is generated between electrodes of the spark plug, plasma energy is given from the power circuit 100" to discharge space where impedance is lowered due to starting of discharge, and plasma is ejected; and therefore, a plasma current PJ-I1 flows. The plasma current PJ-I1 flows and accordingly electric charge charged in the PJ capacitor 9 is discharged and the charging voltage VC1 becomes 0 V.

Thereafter, this operation will be repeated at time t7 to t12.

After that, when an operation mode is switched to a low plasma energy mode at time t13, the High voltage signal Sv5 is inputted to the input terminal 3*c* of the voltage limiting circuit 3, the Low voltage signal Sv3 is inputted to the input terminal 7*a* of the drive circuit 7, and the Low voltage signal Sv4 is inputted to the input terminal 7'*a* of the drive circuit 7', from the ECU 40".

Accordingly, the voltage limiting value of the voltage limiting circuit 3 is set to VCL2'.

The charging voltage VC2 of the tank capacitor 5 reaches the voltage limiting value VCL2' of the voltage limiting circuit 3 at time t14.

When a High voltage signal Sv4 (for example, it is set to after several hundred μsec from the leading edge of the ignition signal Igt) is inputted from the ECU 40" to the input terminal 7'*a* of the drive circuit 7' at time t15, the high breakdown voltage switch 6' becomes an ON state, and charging is started from the tank capacitor 5 to the PJ capacitor 9'.

When the charging voltage VC1' of the PJ capacitor 9' reaches the target charging voltage VC1*max* and the charging voltage VC2 of the tank capacitor 5 reaches the voltage limiting value VCL2' of the voltage limiting circuit 3 at time t16, the operation of the DC/DC converter 2 is made to stop.

The voltage signal Sv4 is switched to Low at time t17 (for example, it is set to the same time as the trailing edge of the ignition signal Igt); however, the voltage limiting value is being set to VCL2', and the operation of the DC/DC converter 2 is being stopped.

As for operation from time t18 to t19, the operation is the same as that of the preferred embodiment 1 and therefore description thereof will not be repeated.

As described above, according to the preferred embodiment 4 of the present invention, plural sets of series connections of the PJ capacitors 9 (9') and the high breakdown voltage switches 6 (6') are connected in parallel to the tank capacitor 5 in the power circuit 100", capacitance values of the PJ capacitors 9 and 9' in the respective series connections are made to be different, any of the PJ capacitors is selected in response to an operation state of the internal combustion engine, and the voltage limiting value of the tank capacitor 5 at the time when the high breakdown voltage switch is OFF is made to be variable in response to the capacitance value of the selected PJ capacitor. Therefore, when the capacitance value of the PJ capacitor is small, the voltage limiting value of the tank capacitor at the time when the high breakdown voltage switch is OFF is set to be lower than the voltage limiting value at the time when the capacitance value of the PJ capacitor is large; and accordingly, operation time of the DC/DC converter in the power circuit 100" is decreased and circuit consumption current and heat generation can be suppressed.

Incidentally, FIG. 8 shows an example where the high voltage diodes 11 and 11' and a rectifying diode 34 are arranged in a direction in which a central electrode of the spark plug 20 is a cathode; however, the high voltage diodes 11 and 11' and the rectifying diode 34 may be naturally arranged in a direction in which the central electrode of the spark plug is an anode.

Various modifications and alternations of this invention will be apparent to those skilled in the art without departing from the scope and spirit of this invention, and it should be understood that this is not limited to the illustrative embodiments set forth herein.

What is claimed is:

1. An ignition device for an internal combustion engine comprising:

a plasma discharge type spark plug;

an ignition coil which supplies a discharge voltage to said spark plug on the basis of an ignition signal; and a power circuit which is connected in parallel to said spark plug, and supplies plasma energy for generating plasma in discharge space of said spark plug at the time of starting of discharge of said spark plug, said power circuit comprising:

a DC/DC converter which is connected to DC power, and outputs a DC voltage;

a PJ capacitor which is connected to the output side of said DC/DC converter, and charges the plasma energy for generating the plasma in the discharge space of said spark plug;

a tank capacitor which is charged by the output of said DC/DC converter, and charges said PJ capacitor at a predetermined time;

a voltage limiting circuit in which a plurality of different voltage limiting values for setting a charging voltage of said tank capacitor are set, and which restricts an output voltage of said DC/DC converter to a predetermined value; and a high breakdown voltage switch which is provided between said tank capacitor and said PJ capacitor, and in which ON/OFF control is performed by a driving signal corresponding to an operation state of said internal combustion engine to control a charging time period of said PJ capacitor, said voltage limiting circuit switching set values of the voltage limiting values by a control signal synchronized with the driving signal of said high breakdown voltage switch.

2. The ignition device for the internal combustion engine according to claim 1, wherein the ignition signal of said spark plug is used as the driving signal of said high breakdown voltage switch.

3. The ignition device for the internal combustion engine according to claim 1, wherein said voltage limiting circuit sets the voltage limiting value at the time when said high breakdown voltage switch is OFF in multiple steps and switches the voltage limiting value in response to engine rotational frequency.

4. The ignition device for the internal combustion engine according to claim 1, wherein said voltage limiting circuit connects plural sets of series connections of said PJ capacitors and said high breakdown voltage switches to said tank capacitor in parallel, makes capacitance values of said PJ capacitors in the respective series connections different, selects any of said PJ capacitors in response to the operation state of said internal combustion engine, and switches the voltage limiting value of said tank capacitor at the time when said high breakdown voltage switch is OFF in response to the capacitance value of selected said PJ capacitor.

* * * * *